US005379837A

United States Patent [19]

Reid

[11] Patent Number: 5,379,837

[45] Date of Patent: Jan. 10, 1995

[54] LOCKING MEMBER FOR SECURING TO A LOCK STRUCTURE IN A CONDUIT

[75] Inventor: Michael A. Reid, Aberdeen, Great Britain

[73] Assignee: Well-Equip Limited, Aberdeen, United Kingdom

[21] Appl. No.: 71,255

[22] Filed: Jun. 4, 1993

[30] Foreign Application Priority Data

Jun. 9, 1992 [GB] United Kingdom ..... 9212162

[51] Int. Cl.[6] ..... E21B 23/00

[52] U.S. Cl. ..... 166/208; 166/217

[58] Field of Search ..... 166/208, 214, 217

[56] References Cited

U.S. PATENT DOCUMENTS

| | | | |
|---|---|---|---|
| 3,646,996 | 3/1972 | Pearce, Jr. | 166/217 X |
| 3,893,717 | 7/1975 | Nelson | 166/208 X |
| 4,121,659 | 10/1978 | Taylor | 166/217 X |
| 4,254,829 | 3/1981 | Watkins . | |
| 4,488,596 | 12/1984 | Akkerman . | |
| 4,506,731 | 3/1985 | Skinner . | |
| 4,580,630 | 4/1986 | Milberger et al. | 166/208 |
| 4,595,054 | 6/1986 | Schroeder | 166/217 |
| 4,883,121 | 11/1989 | Zwart | 166/217 |
| 4,886,115 | 12/1989 | Leggett et al. | 166/217 |
| 4,949,786 | 8/1990 | Eckert et al. | 166/208 |
| 5,070,942 | 12/1991 | McInnes | 166/208 X |
| 5,174,376 | 12/1992 | Singeetham | 166/208 |

FOREIGN PATENT DOCUMENTS

| | | |
|---|---|---|
| 0298683 | 1/1989 | European Pat. Off. . |
| 2332413 | 11/1975 | France . |
| 9305266 | 3/1993 | WIPO . |

*Primary Examiner*—Ramon S. Britts
*Assistant Examiner*—Frank S. Tsay
*Attorney, Agent, or Firm*—Popham, Haik, Schnobrich & Kaufman, Ltd.

[57] ABSTRACT

A lock member (10) is disclosed for securing to a lock structure (14) in a conduit. The lock member (10) comprises a housing (24), a shoulder (16) on the lock structure (10), a locking device (26) movably mounted on the housing (24) for movement between a first retracted position and a second extended position in which the locking device (26) enters a corresponding locking recess (30) in the lock structure (14). The shoulder (16) of the lock member (10) is movably mounted on the housing (24) between a first position in which, in use, the shoulder (16) bears upon the shoulder (18) of the locking structure (14) and the locking device (26) when in the extended position is disengaged from the surfaces of the locking recess (30) of the lock structure (14). When the shoulder (16) of the lock member (10) is in the second axial position, the locking device (26) bears upon a surface of the locking recess (30) so as to bear at least a portion of any load applied to an end of the lock member (10). The lock member (10) also includes a selective locking device (32) for selectively locking the shoulder (16) in the first position. The lock member is particularly advantageous when used in an oil or gas well and especially tubing in oil or gas wells. In this case, the lock member is in the form of a lock mandrel and the lock structure is in the form of a landing nipple.

6 Claims, 2 Drawing Sheets

LOCKING MEMBER FOR SECURING TO A LOCK STRUCTURE IN A CONDUIT

The present invention relates to a lock member, and especially a lock member in the form of a lock mandrel of the type used in oil recovery operations to locate and lock in place various types of flow control equipment within a tubing string.

BACKGROUND OF THE INVENTION

Lock mandrels are designed to engage corresponding landing nipples, located at predetermined positions within the tubing string and designated by size of seal bore.

A typical well completion would consist of several landing nipples made up to the tubing at various depths. The nipples would decrease in seal bore diameter the deeper they are positioned in the tubing string. A landing nipple typically consists of an annular recess to accept radially expandable locking dogs forming part of the lock mandrel, a no-go shoulder against which a corresponding no-go shoulder of the lock mandrel would normally seat in use, and a seal bore.

A typical lock mandrel running procedure would involve the lock mandrel being screwed on to the top of the flow control device (e.g. plug, valve, etc) which is to be installed. A special running tool would be attached to the lock mandrel with shear pins. The assembly is then run into the tubing at the end of a wireline toolstring. When the no-go shoulder of the mandrel hits the corresponding no-go shoulder of the landing nipple, the lock mandrel will stop in proper alignment within the landing nipple. At this point the locking dogs of the mandrel are in their retracted position and are aligned with the locking recess in the landing nipple, and the V-packing stack of the mandrel, if employed is located in the seal bore.

In order to lock and leave the lock mandrel in place, a wireline toolstring is used to jar down in order to shear a set of shear pins in the lock mandrel so as to move the locking dogs into their extended position such that they engage the annular recess of the landing nipple. The running tool is then disengaged from the lock mandrel by jarring upwards to shear a second set of shear pins.

When a lock mandrel is set into a landing nipple in this manner a potential problem arises if pressure is applied from above. The lock mandrel effectively rests on the no-go shoulder of the landing nipple, which has a relatively small area in order to present as little restriction as possible to fluid flow through the nipple. When pressure is applied at the surface against the lock with a plug attached, the load on the nipple no-go shoulder is very high, and excessive pressure can cause damage. Accordingly, all landing nipples are pressure-rated and the rated pressure must not be exceeded.

Previous attempts to up-rate landing nipples having a given no-go shoulder area have centred upon arranging for the load to be carried on the relatively larger contact area between the mandrel locking dogs and the corresponding nipple recess. Such approaches have involved arrangements with deformable no-go shoulders, arrangements in which expansion of the locking dogs lifts the mandrel no-go shoulder off the nipple no-go shoulder, or replacing the no-go shoulder with collapsible fingers. Such approaches have various operational difficulties in practice.

SUMMARY OF THE INVENTION

According to the invention there is provided a lock member for securing to a lock structure in a conduit, the lock member comprising a housing; a shoulder, adapted to engage a shoulder on the lock structure; a locking means movably mounted on the housing for movement between a first, retracted position and a second, extended position in which the locking means enters a corresponding locking recess in the lock structure, the shoulder of the lock member is movably mounted on the housing for movement between a first position in which, in use, the shoulder of the lock member bears upon the shoulder of the locking structure and the locking means, when in the extended position, is disengaged from the surfaces of the locking recess of the lock structure, and a second position in which, in use, the locking means bears upon a surface of the locking recess so as to bear at least a portion of any load applied to an end of the lock member, the lock member further including selective locking means for selectively locking the shoulder in the first position.

Preferably, the locking means comprises a locking dog. Typically, the locking means comprises a number of locking dogs movably mounted on the lock member.

Preferably, the selective locking means comprises a locking dog and typically a number of locking dogs which may be spaced around the circumference of the member and movable between a first, retracted position, in which the shoulder is freely movable between its first and second positions, and a second, extended position in which they lock the shoulder in its first position.

Typically, the shoulder is formed on an annular member which is axially movably mounted on the housing. Preferably, the selective locking means engages the annular member to lock the shoulder in the first position. Preferably, where the selective locking means comprises one or more locking dogs, the dogs in their extended position engage a recess on the annular member.

Preferably, the arrangement is such that the locking dogs for the selective locking means are maintained in their extended position, in use, by a core portion of a running tool attached to the lock member and move to their retracted position upon disengagement of the running tool.

Typically, the lock member is a lock mandrel and the lock structure is a landing nipple. Typically, the landing nipple may be mounted in tubing in a well.

BRIEF DESCRIPTION OF THE DRAWINGS

An example of a lock member in accordance with the invention will now be described, by way of example only, with reference to the accompanying drawings, in which.

DESCRIPTION OF PREFERRED EMBODIMENTS

Figure 1:
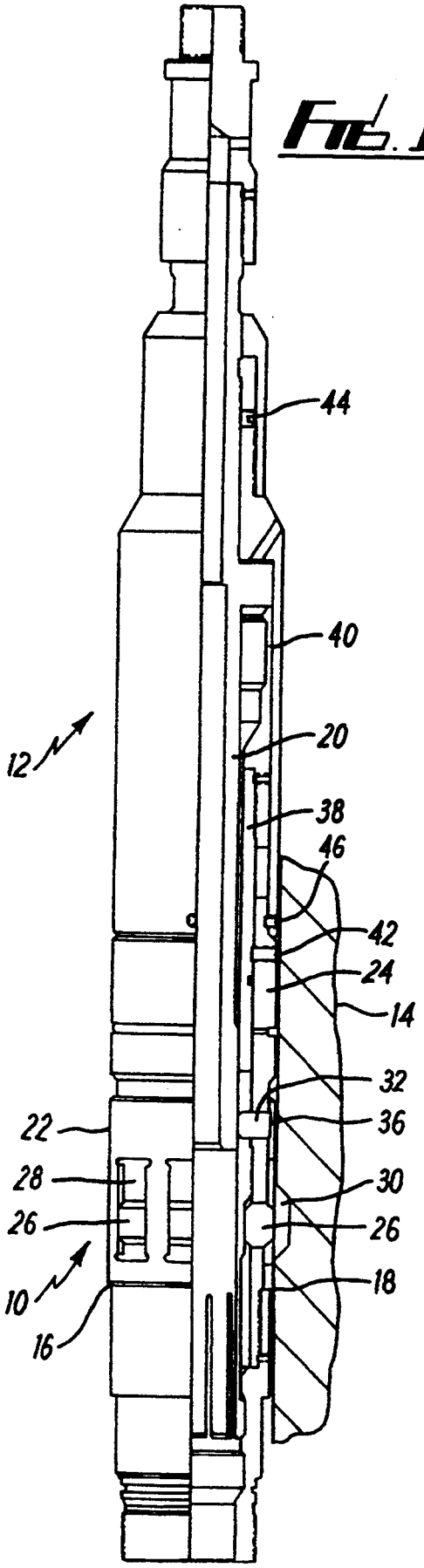
FIG. 1 is a side view, partly in section, of a lock mandrel embodying the invention attached to a running tool and aligned with a landing nipple, showing locking dogs of the mandrel in their retracted position.

Referring now to the drawings, a lock mandrel, generally designated by reference numeral 10, is shown attached to the lower end of a running tool 12. The lock mandrel 10 is located in a tubing string (not shown) aligned with a landing nipple 14 shown in fragmentary cross-section.

Figure 2:
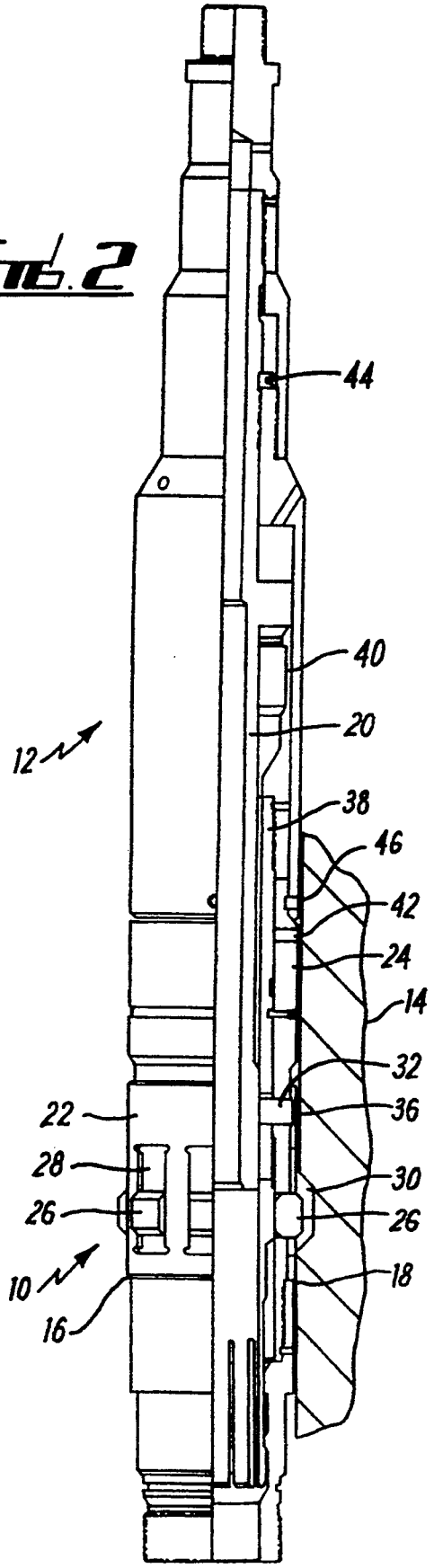
FIG. 2 is a view corresponding to that of FIG. 1, showing the locking dogs of the mandrel in their extended position; and, FIG. 3 is a view corresponding to that of FIGS. 1 and 2 with the running tool removed and the lock mandrel in it final position, with the locking dogs bearing upon a locking recess of the landing nipple.

As seen in FIGS. 1 and 2, a no-go shoulder 16 of the lock mandrel 10 is seated against a corresponding no-go shoulder 18 of the landing nipple 14, and a core portion 20 of the running tool 12 extends into the interior of the lock mandrel 10.

Figure 3:
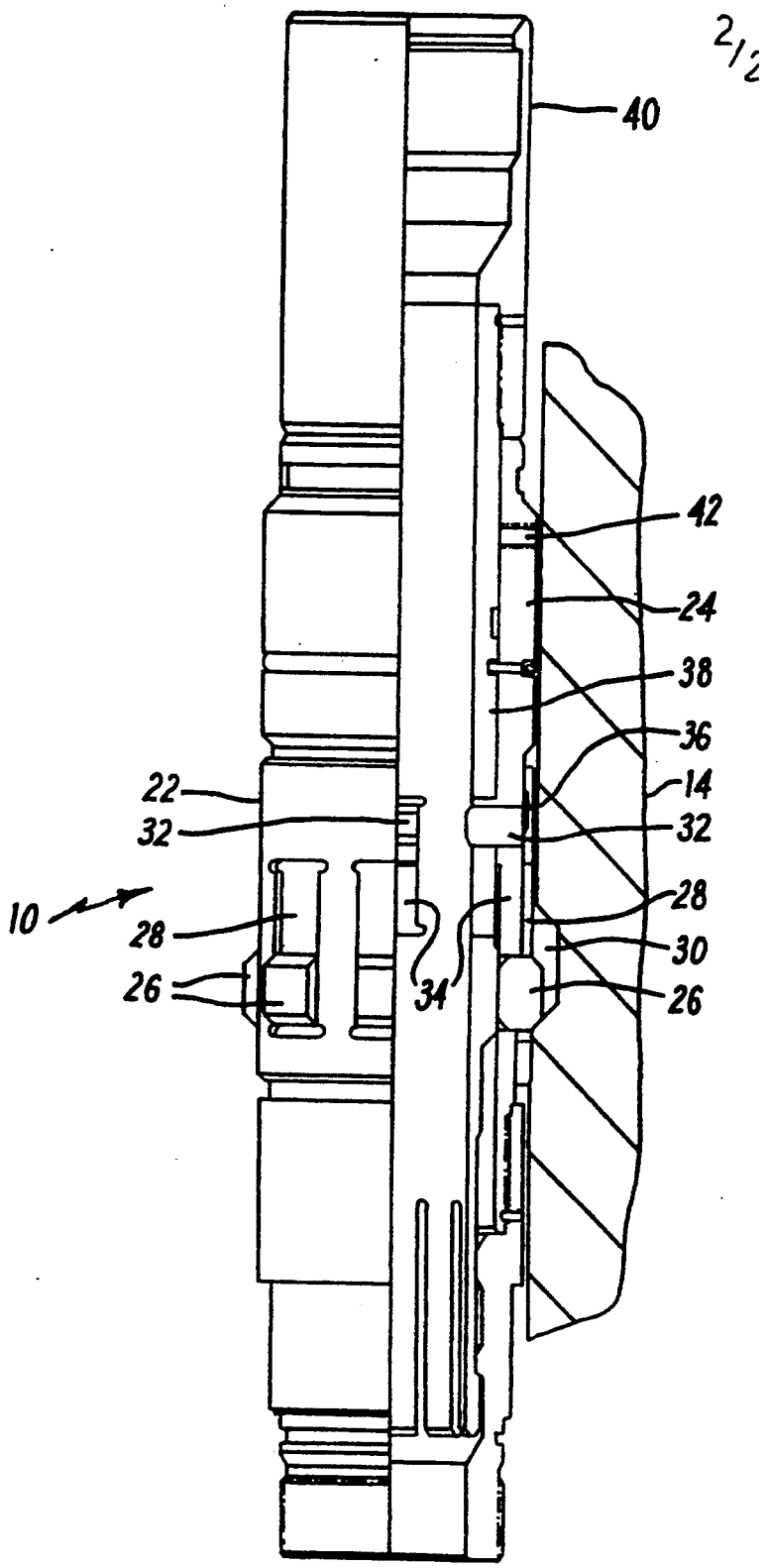

The no-go shoulder 16 of the lock mandrel 10 is formed on an annular member 22 which surrounds a main body portion 24 of the mandrel 10 and is slidable along the longitudinal axis thereof between a first axial position, as seen in FIGS. 1 and 2 and a second axial position as seen in FIG. 3.

The lock mandrel 10 further includes a plurality of locking dogs 26 spaced around the circumference of the mandrel 10 and radially movable between a first, retracted position, as seen in FIG. 1, and a second extended position, as seen in FIGS. 2 and 3, upon operation of the running tool 12 via a wireline toolstring (not shown). The dogs 26 extend through a corresponding plurality of longitudinally extending slots 28 formed in the annular member 22, and are aligned with an annular locking recess 30 of the landing nipple 14 when the respective no-go shoulders 16 and 18 are in contact.

A second plurality of circumferentially spaced locking dogs 32 extend through a corresponding plurality of longitudinally extending slots 34 formed in the main body portion 24 of the mandrel 10 and are also radially movable between a first, extended position (FIGS. 1 and 2) in which they engage a corresponding annular recess 36 formed on the inner surface of the annular member 22 so as to lock the annular member 22 in its first axial position, and a second, retracted position, in which the annular member 22 is free to move between its first and second axial positions. As seen in FIGS. 1 and 2, the second set of dogs 32 are maintained in their extended position by the core portion 20 of the running tool 12 extending into the interior of the lock mandrel 10.

In use, the running tool 12 and the lock mandrel 10, with an appropriate flow control device (not shown) attached thereto, are lowered into the tubing string until the no-go shoulders 16 and 18 engage. A downward jar is applied to the core position of the running tool 12, which is transmitted to an inner sleeve portion 38 of the mandrel 10, via a fishing neck portion 40, shearing a first set of shear pins 42. The sleeve portion 38 moves downwards, moving the first plurality of locking dogs 26 into their extended position in which they project into the locking recess 30 of the landing nipple 14. A tell-tale device 44 on the running tool 12 confirms the proper operation of the assembly.

Once the locking dogs 26 have been set, an upward jar is applied to shear a second set of shear pins 46, allowing the running tool to be disengaged from the mandrel 10 and retrieved. The withdrawal of the core portion 20 of the running tool 12 from the interior of the mandrel 10 releases the second plurality of dogs 32 which are forced inwards to their retracted position by the weight of the mandrel 10. The mandrel 10 then slides downwards through the annular member 22, which is retained in position by the mutually engaging no-go shoulders 16 and 18, until the locking dogs 26 engage the lowermost surface of the locking recess 30 of the landing nipple 10, with the annular member 22 in its second axial position relative to the mandrel 10, as seen in FIG. 3.

The weight of the mandrel 10 and any additional downward load is thus borne by the relatively large contact area between the dogs 26 and recess 30, rather than by the relatively small contact area between the no-go shoulders 16 and 18, providing greater resistance to downwards pressure.

Improvements and modifications may be incorporated without departing from the scope of the invention.

I claim:

1. A lock member for securing to a lock structure in a conduit, the lock structure having a lock structure shoulder and a locking recess, the lock member comprising a housing; an annular member; a lock member shoulder formed on the annular member, and the lock member shoulder adapted to engage the lock structure shoulder; recess locking means movably mounted on the housing for movement between a first, retracted position and a second, extended position in which the recess locking means enters the locking recess in the lock structure; the annular member being axially movably mounted on the housing between a first position in which, in use, the lock member shoulder bears upon the lock structure shoulder and the recess locking means when in the extended position is disengaged from the surfaces of the locking recess of the lock structure, and a second position in which, in use, the recess locking means bears upon a surface of the locking recess so as to bear at least a portion of any load applied to an end of the lock member; and shoulder locking means for selectively locking the lock member shoulder in the first position.

2. A lock member according to claim 1 wherein the recess locking means comprises a locking dog.

3. A lock member according to claim 1, wherein the shoulder locking means comprises a locking dog.

4. A lock member according to claim 3, wherein the locking dog is maintained in the extended position, in use, by a running tool attached to the lock member and upon disengagement of the running tool from the lock member, the locking dog moves to the retracted position.

5. A lock member according to claim 1, wherein the lock member is a lock mandrel and the lock structure to which it is secured in use is a landing nipple.

6. A lock member according to claim 1 or claim 5, wherein the lock member is for use in a borehole or well.

* * * * *